US006314594B1

(12) United States Patent
Meoli, Jr. et al.

(10) Patent No.: US 6,314,594 B1
(45) Date of Patent: Nov. 13, 2001

(54) SPREADER BAR FOR A HAMMOCK

(75) Inventors: Rudy B. Meoli, Jr., Placentia; Armando Padilla, Torrance, both of CA (US)

(73) Assignee: E-Z Sales & Manufacturing, Gardena, CA (US)

( * ) Notice: Subject to any disclaimer, the term of this patent is extended or adjusted under 35 U.S.C. 154(b) by 0 days.

(21) Appl. No.: 08/609,551

(22) Filed: Mar. 1, 1996

(51) Int. Cl.[7] ..... A45F 3/22
(52) U.S. Cl. ..... 5/120; 5/122; 5/123
(58) Field of Search ..... 5/120, 122, 123, 5/127, 98.3

(56) References Cited

U.S. PATENT DOCUMENTS 221,754 * 11/1879 Travers ..... 5/122
342,668 * 5/1886 Woodbury ..... 5/122
369,546 * 9/1887 Nickerson ..... 5/123
416,242 * 12/1889 Sutphen ..... 5/123
468,576 * 2/1892 Palmer ..... 5/123
469,869 * 3/1892 Palmer ..... 5/123
631,747 * 8/1899 Lloyd ..... 5/123
1,515,263 * 11/1924 Matsusaki ..... 5/122

* cited by examiner

*Primary Examiner*—Lynne H. Browne
*Assistant Examiner*—Fredrick Conley
(74) *Attorney, Agent, or Firm*—Chris Papageorge

(57) ABSTRACT

An improved spreader bar for spreading apart the cords which connect the body supporting member of a hammock to a support structure and suspend it therefrom is disclosed. The spreader bar is positioned adjacent each of the longitudinal end portions of the body supporting member and is provided with spaced apertures which receive the cords therein. The spreader bar is curved outwardly relative to the body supporting member in order to evenly distribute the suspension forces exerted on the aperture walls by the cords. The spreader bar is also split proximal to or at the apertures into upper and lower members to provide access to the apertures through top portions thereof when the upper and lower members are separated and thereby facilitate insertion of the cords therein when the upper and lower members are separated. Snap connectors on the spreader bar enable the upper and lower members to be securely joined together thereby closing off the top portions of the apertures and preventing removal of the cords from the apertures when the members are joined together.

15 Claims, 7 Drawing Sheets

FIG. 3
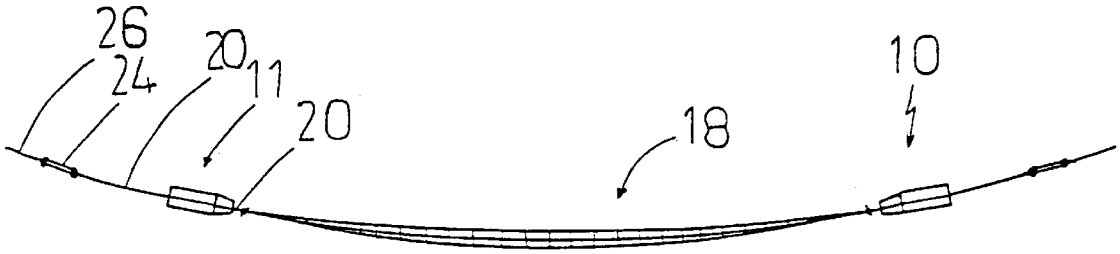
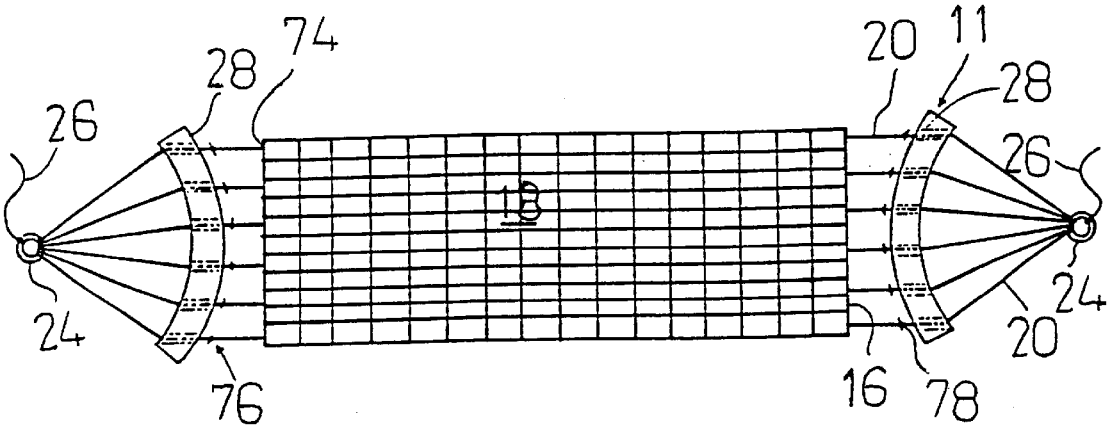
FIG. 2

FIG. 8
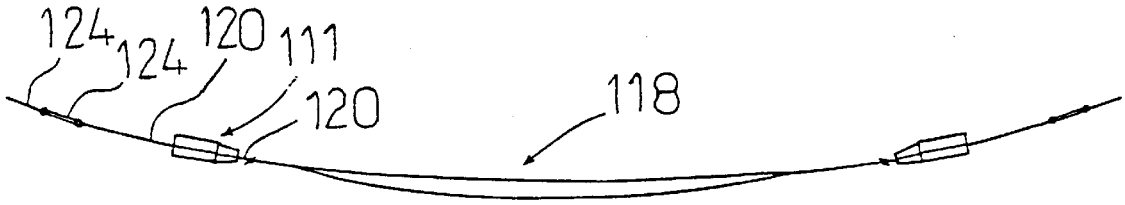
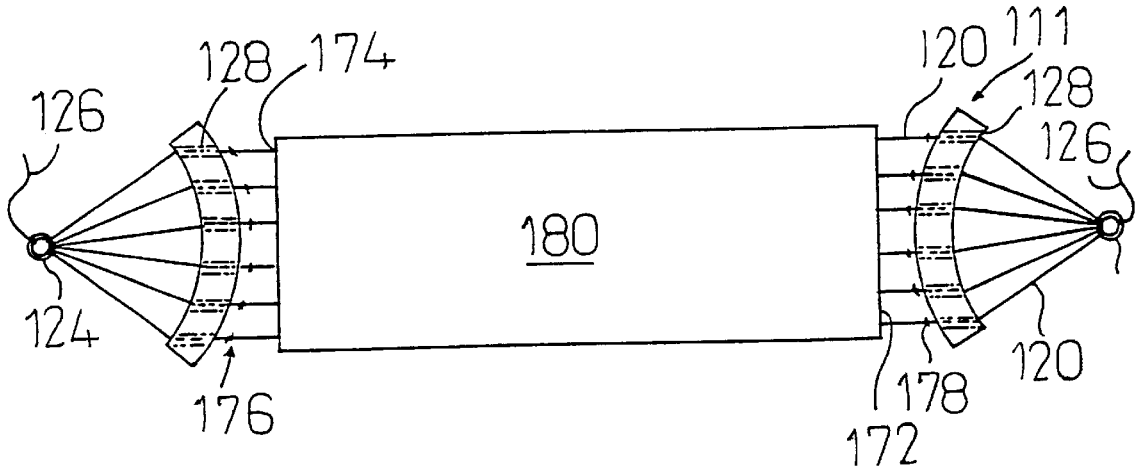
FIG. 7

SPREADER BAR FOR A HAMMOCK

This application contains subject matter disclosed and claimed in co-pending, simultaneously filed and commonly owned patent application by inventors herein entitled "An Improved Hammock".

BACKGROUND OF THE INVENTION

The invention generally relates to spreader bars for spreading apart the cords utilized in hammocks and thereby laterally spread out the body supporting member of the hammock in order to provide fuller support to the user. The invention relates more particularly to such a spreader bar for a hammock which provides increased safety and which facilitates assembly of a hammock by an assembly plant [during the manufacturing process] or by an end user to replace a prior art spreader bar on a hammock or to install on a hammock which lacks a spreader bar.

Hammocks are an inexpensive apparatus for supporting an individual in a reclining position. They are especially useful because they may be suspended from trees, poles and many other types of structures, and this feature makes them advantageously adaptable for use in many different types of outdoor environments. Hammocks may thus be used in locales where tents and other types of rest providing equipment may not pragmatically be used due to rocky terrain, excessive vegetation, wet ground surfaces, etc. Consequently, hammocks have been widely used in conjunction with camping and other types of outdoor recreational activities. For such outdoor use hammocks also have the added advantage that since they are typically suspended above the ground which may often be hard, rocky, uneven, wet, cold, dirty or infested with insects they nevertheless provide comfort to the user despite such ground surface characteristics of the surrounding area.

Some of the oldest designs for hammocks utilize spreader bars to separate the suspension cords and thereby laterally extend the body supporting member of the hammock to provide fuller and generally flatter support and thereby a more comfortable surface for the user to lie on. However, such spreader bars have typically been straight which has the disadvantage that the stresses placed thereon by the suspension cords are unevenly distributed on the bars, and this may result in breakage of the bar or produce an unstable hammock which is more likely to excessively rotate while in use and dump the user. Conventional spreader bars for hammocks typically are provided with apertures for the suspension cords to pass through and are of unitary construction which requires that the hammock be assembled by feeding the cords through the apertures and subsequently securing the cords to the other components of the hammock. This requirement makes the assembly of such hammocks more labor intensive which increases manufacturing costs thereof.

Many types of hammock spreader bar designs position the spreader bars at the longitudinal ends of the body supporting member to maintain the supporting member in a spread position. An example of such a design is disclosed in U.S. Pat. No. 4,800,601 to DeCaro. DeCaro utilizes a straight bar which has angled retaining members forming one C-shaped slot at one end thereof which holds the ends of the supporting member in a spread condition and another C-shaped slot at the other end thereof which holds the ends of the supporting cords therein. Although the DeCaro spreader bar was designed to make the hammock more inexpensive to manufacture than hammocks with comparable features, it nevertheless requires considerable labor to attach the suspension cords to the spreader bar. Consequently, assembly of hammock components to the spreader bars adds significantly to the costs of manufacture of the hammock.

Many other types of hammocks utilize relatively simple spreader bar designs to provide the desired function of laterally spreading out the body supporting member. Examples of such hammock spreader bars are disclosed in U.S. Pat. No. 4,162,550 to Willingham and 4,686,720 to Newell. The Willingham hammock utilizes a spreader bar which is straight and provided with apertures through which the suspension cords pass. The Willingham spreader bar is secured to the body supporting member directly at the ends thereof while the Newell spreader bar is secured to suspension cords which are secured to the body supporting member at the ends thereof. However, such designs have the disadvantage that the forces exerted on the spreader bar are concentrated at the end portions thereof. This may result in undue stresses at these portions which may result in failure of the components or flipping over of the hammock under use because the forces are not evenly distributed laterally.

Some types of hammocks include spreader bars which are designed to provide a taut hammock sheet. An example of such a spreader bar design is disclosed in U.S. Pat. No. 4,021,868 to Fueslein. In the Fueslein design, the spreader members are positioned underneath the hammock sheet at medial portions and near end portions thereof. The spreader members are vertically curved in order to prevent contact with the user. However, since the suspension cords are located only at the peripheral lateral edges of the sheet, the forces of suspension are concentrated at these edges instead of being evenly distributed at other edges of the sheet. Thus, these peripheral edges are required to withstand the stresses produced by the user's weight. Consequently, such designs have the disadvantage that they may not be able to withstand prolonged use.

A spreader bar for a hammock is thus needed which renders the hammock safer to use and more inexpensive to manufacture. A spreader bar for a hammock is also needed which provides these features while being simple in construction and thus inexpensive to manufacture. An improved spreader bar for a hammock is also needed which allows an end user to quickly and easily replace a conventional spreader bar on a finished hammock with the improved spreader bar and to quickly and easily install the improved spreader bar on a finished hammock which is not provided with a spreader bar.

SUMMARY OF THE INVENTION

It is a principal object of the present invention to provide a spreader bar for a hammock which provides enhanced safety to the user of the hammock.

It is another object of the present invention to provide a spreader bar for a hammock which provides more even distribution of forces exerted on the spreader bar and other components of the hammock.

It is also an object of the present invention to provide a spreader bar for a hammock which provides reduced stress on the spreader bar and other components of the hammock.

It is also an object of the present invention to provide a spreader bar for a hammock which entails minimal labor for assembly of the hammock.

It is an object of the present invention to provide a spreader bar for a hammock which enables quick and easy replacement of a conventional spreader bar on a hammock therewith.

It is an object of the present invention to provide a spreader bar for a hammock which is simple in construction and inexpensive to manufacture.

Basically, the improved spreader bar of the present invention is specifically designed to minimize the stresses thereon as well as to evenly distribute the forces exerted thereon by the hammock cords which pass therethrough and which transfer the weight of the user to the spreader bar. By obviating uneven distribution of forces, the improved spreader bar of the present invention reduces the likelihood that the user's weight would produce unbalanced forces that would result in rotation of the hammock and thereby toppling of the user and also reduces the likelihood that the user's weight would produce concentration of forces that would result in breakage, failure or malfunction of an overstressed spreader bar or of other overstressed components of the hammock. The unique curved shape of the spreader bar provides more even distribution of forces exerted thereon. When installed around the suspension cords of a hammock, one spreader bar is positioned at one longitudinal end of the body supporting member while another spreader bar is positioned at the other longitudinal end of the body supporting member. The spreader bar is curved horizontally and is also horizontally split into an upper and a lower member. The spreader bar also includes apertures which extend through the spreader bar. When the spreader bar is part of an assembled hammock, suspension cords extend through the apertures and are connected to the body supporting member. The curvature of the spreader bar places the stresses resulting from the user's weight at the inner wall portions of the apertures, and this location is that where the cords come in contact with the aperture walls. Additionally, the curvature of the spreader bar distributes the stresses evenly on these wall portions of every aperture. In contrast, conventional straight bar designs concentrate the stresses on the walls of the outer apertures and also concentrate these stresses on the lower wall portions of these outer apertures. Thus, conventional designs direct the forces perpendicular to the direction of elongation of the spreader bar such that the forces act in a direction in which the bar is structurally weakest making it more likely to bend the bar producing cracks or breakage thereof. In contrast, the improved design of the present invention directs the forces parallel to the direction of elongation such that forces act in a direction in which the bar is structurally strongest making the spreader bar better able to withstand these forces. In addition, in the improved spreader bar, these forces are equally distributed onto all of the cords in the hammock of the present invention. In contrast, conventional straight bar designs concentrate the stresses on the outer cords. Consequently, the more even distribution of stresses provided by the improved hammock design reduces the likelihood of breakage or failure of the spreader bar and other components of the hammock. In addition, the more even distribution of forces means that shifting weight of the user will result in smoother transfer of forces to adjacent cords (as well as spreader bar portions), whereas in conventional straight bar designs the user's weight is borne by predominantly only the outer cords so that transfer of weight is likely to occur only between these two cords (which are not adjacent each other) and between opposite end portions of the spreader bar. Thus, this improved design which results in improved weight transfer makes it less likely that the hammock will suddenly rotate completely around or rotate to an excessive degree resulting in toppling of the user from the hammock. In contrast, in hammocks using a conventional straight bar, shifting of the user's weight laterally may result in transfer of the user's weight completely off one of the lateral end portions of the spreader bar producing a severe unbalancing of the loads thereon and consequent sudden excessive rotation of the hammock and toppling of the user.

The improved spreader bar of the present invention is also specifically designed to facilitate its assembly onto the other components of the hammock reducing the labor costs involved and additionally facilitates assembly of the other hammock components together reducing the labor costs involved and thereby reducing the cost of manufacture of the hammock. The unique bifurcated design of the spreader bar of the present invention facilitates its installation onto the suspension cords of the hammock and allows such installation to be performed after the suspension cords are attached to other components of the hammock. In conventional hammock assembly processes, the suspension cords must be threaded through the apertures of the spreader bar before being attached to other components of the hammock. In such conventional assembly processes the spreader bar is installed onto the cords while the cords are being attached to, for example, the retainer rings, and this positions the spreader bars in the way of the cord attachment process thereby making the process more awkward and more labor intensive. Thus, the unique two piece design of the spreader bar provides more ease of assembly of a hammock and reduces the time and labor involved.

The spreader bar is horizontally split into an upper member and a lower member. Separation of the members exposes an open wall of each of the apertures thereby providing access directly to each of the apertures. The members are separate from each other prior to their assembly onto other components of the hammock allowing the suspension cords to be inserted into the apertures of the spreader bar while or after attachment of the cords to the other components of the hammock. In contrast, conventional one piece bar designs require the cords to be individually fed through each corresponding one of the apertures. The installation of the cords into the apertures is thus less labor intensive than prior art hammock designs. After installation of the cords into the apertures, the upper and lower members are simply joined together and the assembly is complete. However, in prior art hammock spreader bar designs, after the cords are installed in the apertures they must subsequently be attached to other components which is more awkward and difficult because the bars have become a part of the assembly and are proximal to other hammock components which are to be a part of the attachment process and thus likely to be in the way of the attachment process. Moreover, attachment of the cords to other components prior to installation of the spreader bars thereon is apt to be simple and easy because the cords may be quickly and easily extended and directly attached to the other components of the hammock, and reduction of the number of components involved in this step of the process facilitates visual quality control inspection of the process. Assembly of the hammock of the present invention thus requires fewer man hours to accomplish resulting in a more inexpensive hammock.

The improved spreader bar design also enables an end user to install the spreader bar on a conventional hammock which lacks a spreader bar or to replace the existing spreader bar on a conventional hammock. Replacement of the spreader bar is a viable option for the end user because it is not necessary that other components of the hammock be detached from any other components in order to perform the replacement. Instead, after the existing spreader bar is severed from or otherwise removed from the other components of the hammock, the separated upper and lower members of the spreader bar are positioned adjacent the suspension cords. Subsequently, the cords are simply and easily inserted into the apertures of the spreader bar, as described above with regard to the assembly process for manufacture of the hammock. In the final step of the replacement process the upper and lower bar members of the spreader bar are manually pressed together for a secure interconnection. The replacement is thus quickly and easily performed, and no special tools are required for installation of the spreader bar onto the suspension cords of the otherwise conventional hammock. The improved spreader bar design thus enables the user to acquire the safety and improved function benefits afforded by the present invention without having to purchase a new hammock.

The suspension cords are connected to a pair of retainer rings which serve to retain the outer ends of the cords in a generally converged position. A pair of ropes are also connected to the rings. Tying or otherwise attaching the ropes to a suitable pair of trees, poles, etc. provides the desired suspension of the hammock therefrom. When the spreader bars are mounted around the suspension cords, the spreader bars perform their desired function of spreading the suspension cords apart. This in effect laterally extends the body supporting member and thereby provides a wider and more effective support surface for the user's body when the suspension cords are properly taut and additionally brings the suspension forces into generally horizontal alignment at the longitudinal ends of the body supporting member providing the body supporting member with a generally flatter support surface characteristic.

BRIEF DESCRIPTION OF THE DRAWINGS

FIG. 2 is a top view of the first embodiment showing the positioning thereof relative to other components of the hammock shown in FIG. 1.

FIG. 3 is a side elevational view of the first embodiment showing the positioning thereof relative to other components of the hammock shown in FIGS. 1 and 2.

FIG. 7 is a top view of a second embodiment of the spreader bar of the present invention showing its positioning relative to other components of the hammock.

FIG. 8 is a side elevational view of the second embodiment.

DETAILED DESCRIPTION OF THE PREFERRED EMBODIMENTS

Figure 1:
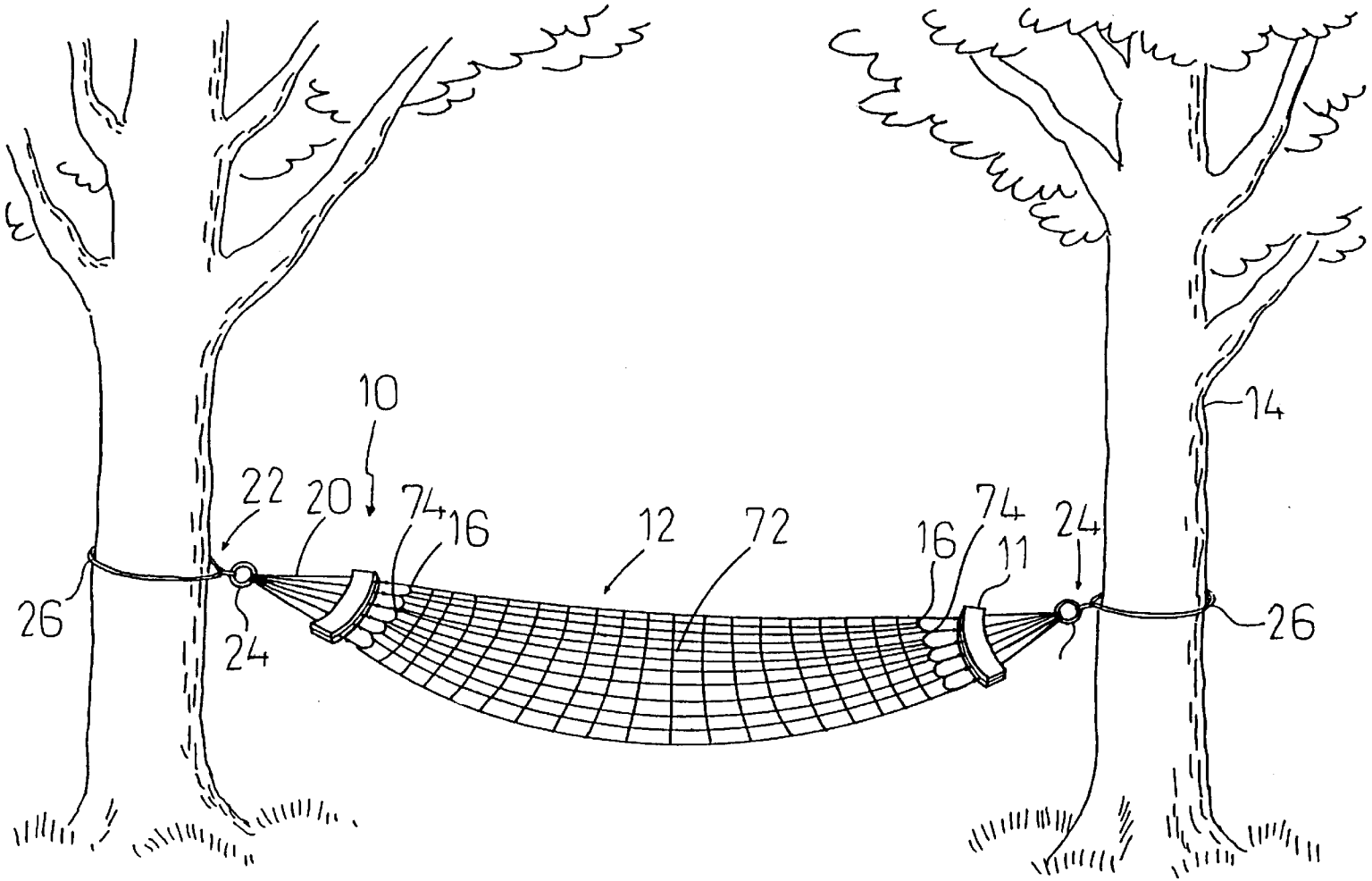
FIG. 1 is a perspective view of a first embodiment of the spreader bar of the present invention depicted as a component part of an assembled hammock which is shown suspended from a pair of trees.
Figure 4:
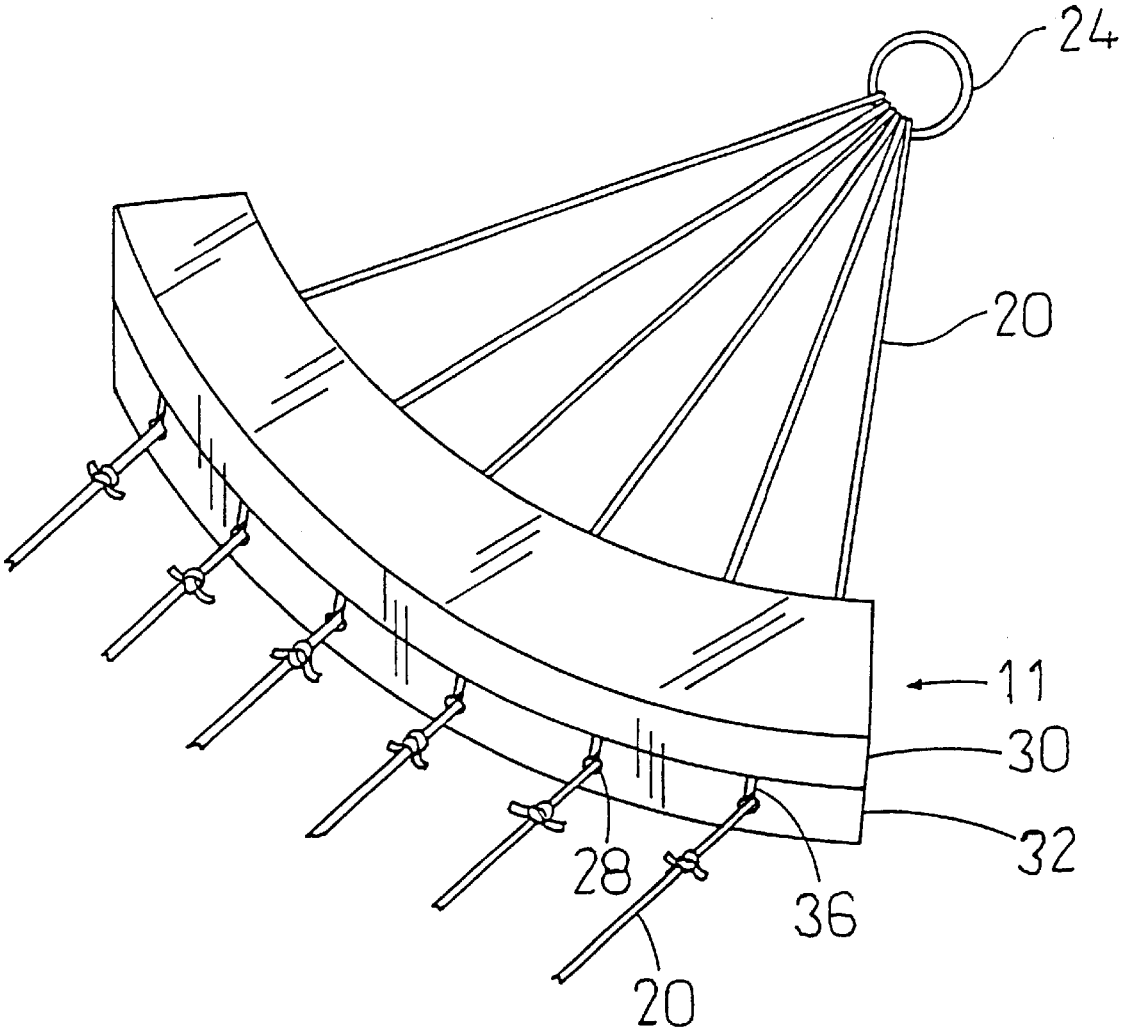
FIG. 4 is a perspective view of the first embodiment showing suspension cords which are associated therewith inserted in the apertures thereof.

A first embodiment of the spreader bar of the present invention, generally designated by the numeral 10, is shown in FIG. 1 as a component part of a completely assembled hammock 12 which is shown tied to two trees 14 and suspended therefrom. The hammock 12 preferably utilizes a pair of spreader bars 10 which are positioned at opposite longitudinal ends 16 of a body supporting member 18. The spreader bars 10 are installed onto a set of suspension cords 20 which interconnect the longitudinal ends 16 of the body supporting member 18 and a means for attaching 22 which attaches the hammock 12 to the pair of trees 14 or other suitable external structure. The means for attaching 22 preferably includes a pair of retainer rings 24 to which the set of cords 20 are attached and a pair of ropes 26 connected to the rings at a diametrically opposed portion thereof. The ropes 26 are tied to the trees 14 and thereby suspend the body supporting member 18 and the other component parts of the hammock 12 from the trees 14.

As shown in FIG. 1 and also more particularly in FIG. 2, the spreader bars 10 are utilized to spread apart the suspension cords 20 at a location proximal to the longitudinal ends 16 of the body supporting member 18 and thereby laterally spread out the body supporting member 18 so as to provide a fuller support for the user to lie on. The spreader bars 10 also serve to bring the suspension cords 20 into horizontal alignment at a location proximal to the longitudinal ends 16.

Each of the pair of spreader bars 10 comprise a spreader bar body 11 and are preferably provided with apertures 28 which extend completely through the spreader bars 10. The apertures 26 receive the set of suspension cords 20 therein and serve to laterally spread apart the suspension cords 20, as shown in FIG. 2. When the ropes are tightly connected to the trees 14 and the body supporting member 18 bears the weight of the user such that the suspension cords 20 are taut, the spreader bars 10 also serve to laterally spread apart the body supporting member 18 in order to provide fuller support to the user. The apertures 28 are preferably also evenly spaced apart in order to evenly distribute the suspension forces exerted on the spreader bars 10 and the suspension cords 20. The apertures 28 are preferably also longitudinally oriented and longitudinally straight. The apertures 28 are preferably six in number, and the bar body 11 preferably does not include an aperture at the center of the bar body 11.

The apertures 28 are preferably larger in cross-sectional size than the individual cords 20 in order to allow free movement of the cords 20 relative to and within the apertures 28.

The spreader bars 10 are preferably curved horizontally transverse relative to the direction of elongation of the spreader bar body 11. When connected to the body supporting member 18, the spreader bars 10 are preferably curved horizontally and longitudinally outwardly relative to the body supporting member 18 so that the suspension forces are evenly distributed horizontally on the bars 10. Each of the apertures 28 thus bears approximately the same degree of force of suspension as the other apertures 28 resulting in reduced concentration of stress on the bars 10 as well as on the apertures 28. The arc of curvature of the bars 10 preferably has a radius of approximately twenty-two inches. Due to the unique curved shape of the spreader bars 10, the suspension forces exerted on the apertures are located at the inner portions 21 of the walls 34 which define the apertures 28.

Figure 5:
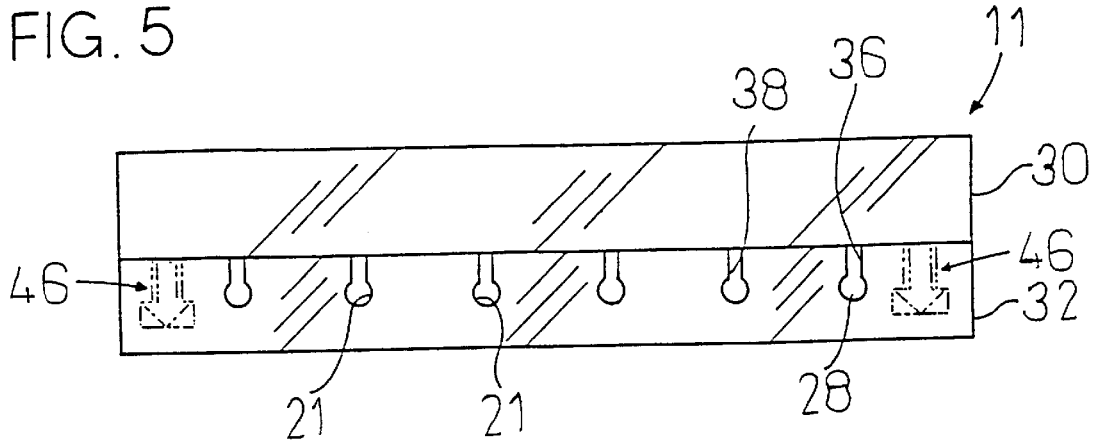
FIG. 5 is a front plan view of the first embodiment showing the features thereof in more detail.
Figure 6:
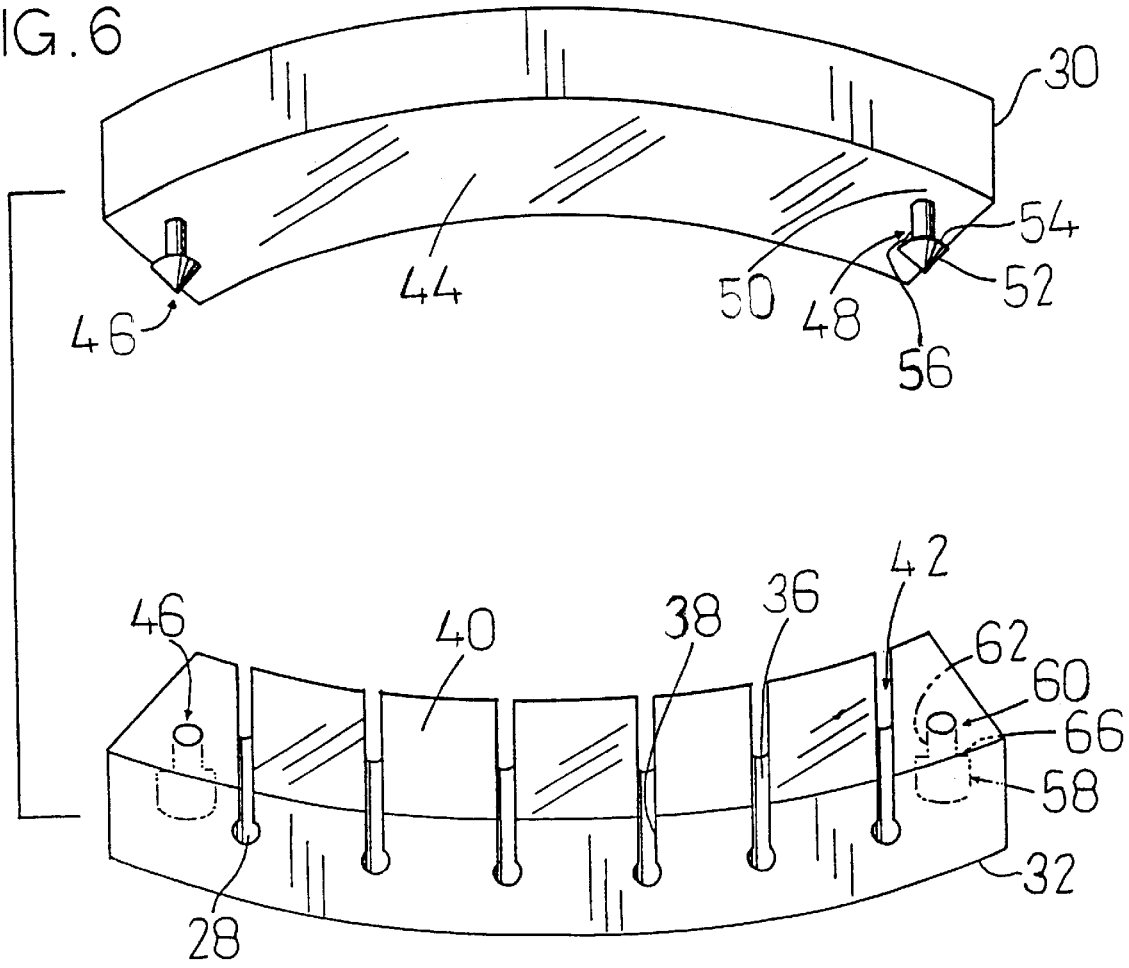
FIG. 6 is a front perspective exploded view of the first embodiment.

Each of the pair of spreader bars 10 is preferably divided or split horizontally into an upper bar member 30 and a lower bar member 32, as shown in FIGS. 5 and 6. It is preferably the lower bar member 32 which is provided with the apertures 28 which preferably also extend horizontally through the lower bar member 32 in preferably a longitudinal direction. The apertures 28 are preferably tubular but may optionally be of any other suitable shape. Lower bar member 32 is preferably also provided with channels 36 positioned at the upper portions 38 of the walls 34. The channels 36 extend from the upper portions 38 of the walls 34 to the upper surface 40 of the lower bar member 32 thereby providing an opening 42 extending from the apertures 28 to the upper surface 40 of the lower bar member 32. The channels 36 thus provide access to the apertures 28 enabling the set of cords 20 to be inserted through the channels 36 and into the apertures 28 resulting in simple, fast and easy installation of the cords 16 into the apertures 28. The channels 36 are preferably oriented perpendicular to the surface 40. Advantageously, the installation of the cords 20 may be performed when the remaining components of the hammock 10 are assembled together or prior thereto.

Upper bar member 30 preferably has a generally flat lower surface 44 so that when the upper and lower bar members 30 and 32 are positioned together such that the upper surface 38 is adjacent the lower surface 44 the lower surface 44 covers the openings 42, as shown in FIG. 5. This effectively blocks access to the channels 36 and the apertures 28 via the top of the lower bar member 32. Thus, when the upper and lower bar members 30 and 32 are positioned together, the cords 20 cannot be removed from the apertures 28 without their disconnection from the rings 24 and/or body supporting member 18.

Each of the upper and lower bar members 30 and 32 preferably have snap connectors 46 enabling the members 30 and 32 to be securely joined together by simply pressing the upper and lower bar members 30 and 32 together, as shown in FIGS. 5 and 6. The snap connectors 46 preferably include male connectors 48 mounted on the upper bar member 30 and at the lower surface 44 and at end portions 50 thereof. Each male connector 48 preferably includes an inverted cone structure 52 with a horizontally flat surface 54 at its medial portion 56. The snap connectors 46 also preferably include female connectors 58 mounted on the lower bar member 32 at the upper surface 40 and at end portions 60 thereof. Each female connector 58 preferably includes a constriction 62 at the upper portion 64 thereof which has a horizontally flat surface 66 at its medial portion 68. The taper of the cone structure of the male connector 48 facilitates insertion of the male connector 48 into the female connector 58 until the upper and lower surfaces 40 and 42 are adjacent to and contacting each other. In this relative position the horizontal surface 66 of the female connector 58 is above but adjacent to the horizontal surface 54 of the male connector 48 thereby effectively retaining the connectors 48 and 58 and the upper and lower bar members 30 and 32 in a joined together position. Alternatively, the upper and lower bar members 30 and 32 may simply be screwed together. Once the upper and lower bar members 30 and 32 are joined together, the cords 20 cannot be removed from the apertures 28 via the channels 36 and are thus effectively retained therein.

The body supporting member 18 preferably includes a set of support cords 70 which are interconnected to form a net 72. The set of suspension cords 20 are preferably connected to opposing longitudinal ends 16 of the net 70 at connection points 74 thereof which are evenly spaced apart in order to evenly distribute the suspension forces exerted on the net 72. The suspension cords 20 are also preferably knotted at locations 76 thereof between the net 70 and the spreader bars 10. Alternatively, the suspension cords 20 may simply be tied to the support cords 70 so as to form the knots 78 at the locations 76. The knots 78 are preferably larger than the diameter of the apertures 28 to prevent the spreader bars 10 from sliding down over the knots 78 and excessively close to or encroaching on the net 72. This prevents the spreader bars 10 from undesirably contacting the user's head or feet and thereby interfering with the user's comfort.

A second embodiment 110 of the invention is depicted in FIGS. 7 through 11. The second embodiment 110 is essentially identical to the first embodiment 10 except for the orientation of the apertures 128, the omission of the channels 36 and the structuring of the male connectors 148.

Figure 9:
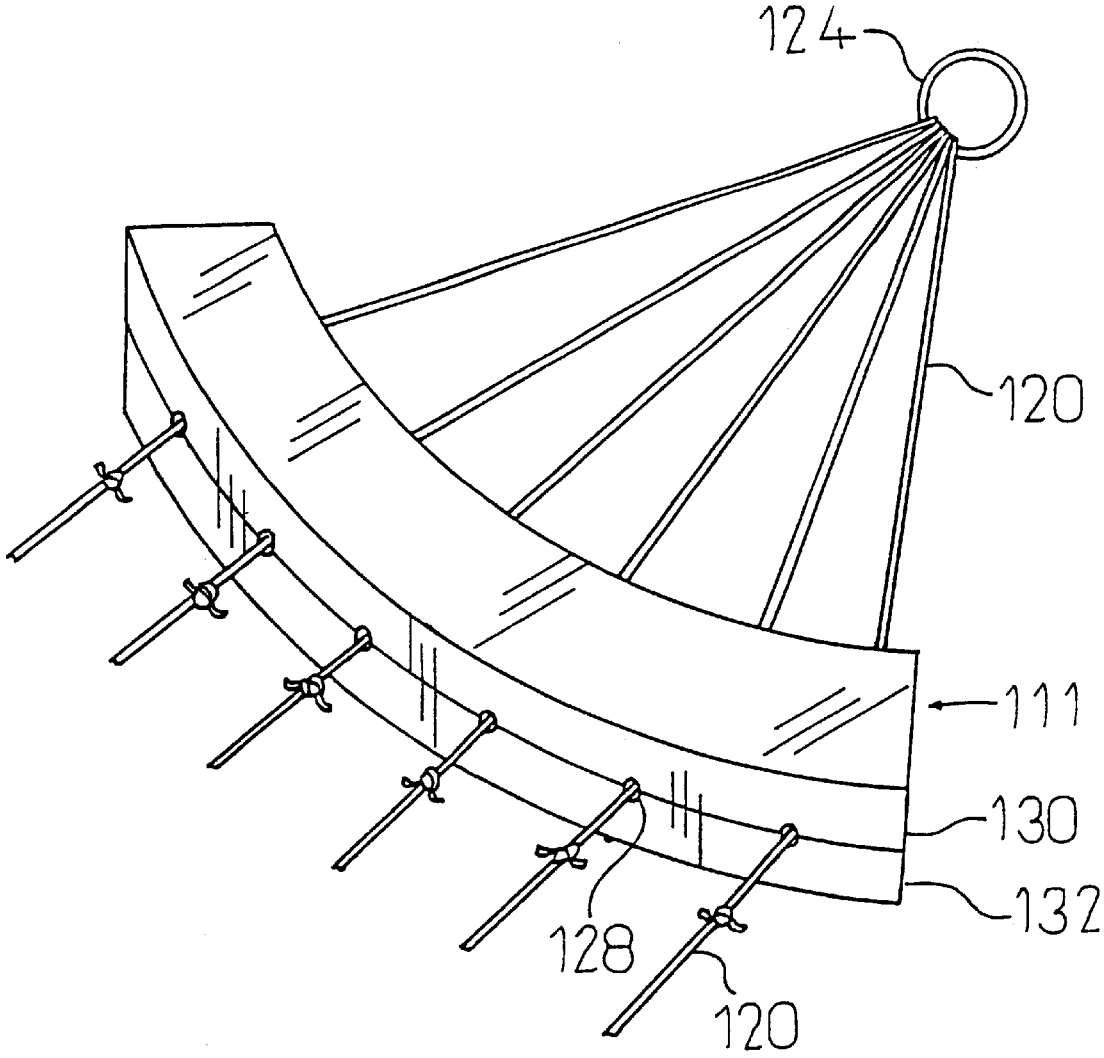
FIG. 9 is a perspective view of the second embodiment showing suspension cords which are associated therewith inserted in the apertures thereof.

As with embodiment 10, embodiment 110 also includes a pair of spreader bars 110 each of which comprise a spreader bar body 111. The spreader bar body 111 is also preferably curved horizontally transverse relative to the direction of elongation of the spreader bar body 11 and horizontally and longitudinally outwardly relative to the body supporting member 118 so that the suspension forces are evenly distributed horizontally on the bar body 111 in order to minimize the concentration of stresses on the bar body 111 and other components of the hammock 112, as shown in FIGS. 7 and 9. The arc of curvature of the bar body 111 preferably has a radius of approximately twenty-two inches. The center point of the arc of curvature of the bar body 111 is approximately at the respective ring 124 to which the set of cords 120 passing through the bars are connected. The spreader bars 110 are also preferably laterally dimensioned so that they are approximately equal to the shoulder width of an average size user.

The pair of spreader bars 110 are preferably also provided with apertures 128 which extend completely through the spreader bars 110, as shown in FIG. 7. The apertures 128 receive the set of suspension cords 120 therein and serve to laterally spread apart the suspension cords 120. The apertures 128 are preferably also evenly spaced apart in order to evenly distribute the suspension forces exerted on the spreader bars 110 and the suspension cords 120. The apertures 128 are preferably also radially oriented with reference to the arc of curvature of the bars 110 and straight.

Figure 10:
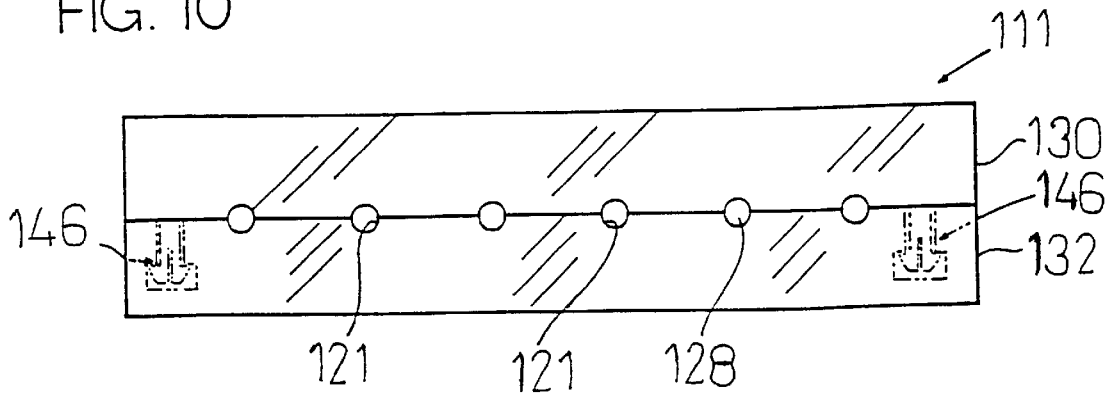
FIG. 10 is a front plan view of the second embodiment showing the features thereof in more detail.
Figure 11:
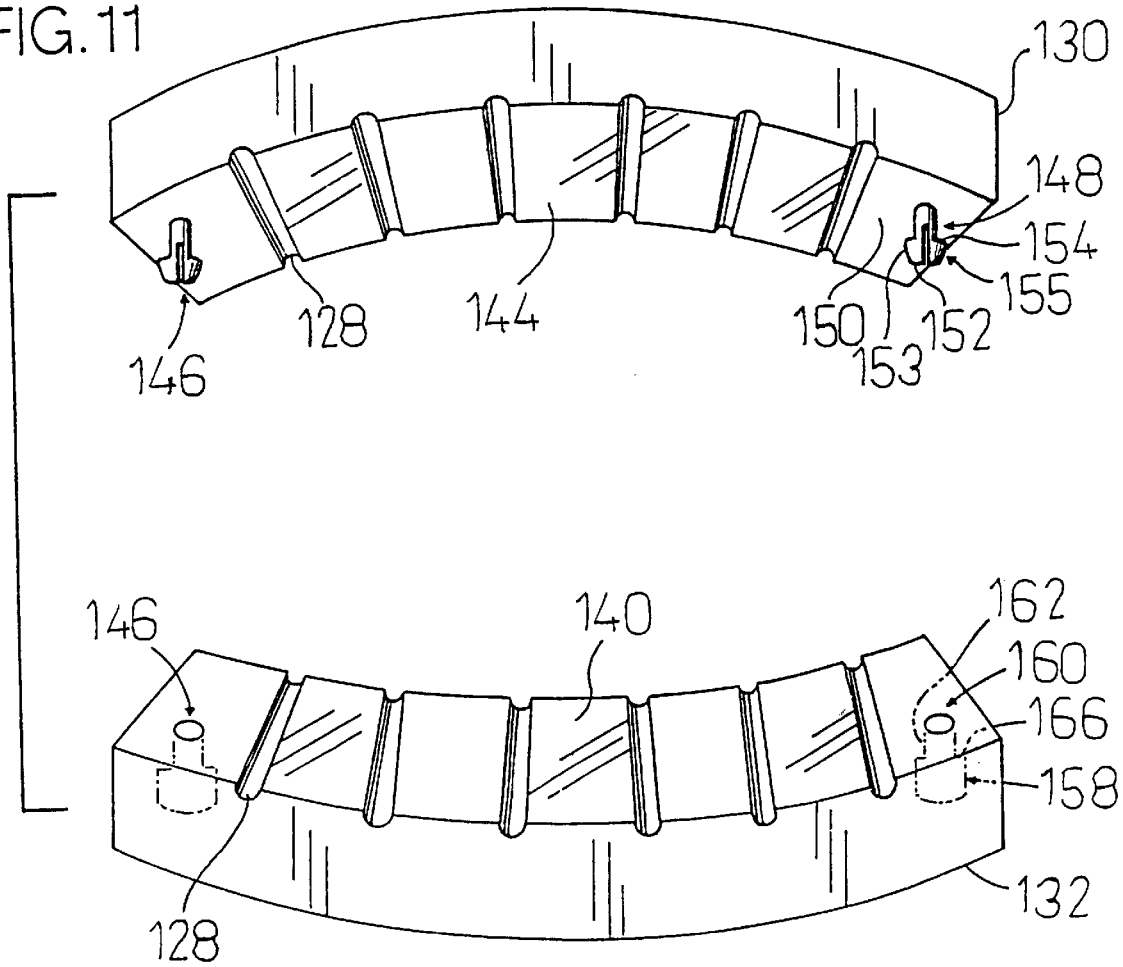
FIG. 11 is a front perspective exploded view of the second embodiment.

Each of the pair of spreader bars 110 is preferably divided or split horizontally into an upper bar member 130 and a lower bar member 132, as shown in FIGS. 10 and 11. Preferably both the upper bar member 130 and lower bar member 132 include a respective portion of the walls 134 which define the apertures 128. Thus, the spreader bars 110 have a plane of division which cuts through the apertures 128. The upper and lower bar members 130 and 132 have preferably flat lower surfaces 144 and flat upper surfaces 140 respectively which lie in or adjacent to the plane of division when the upper and lower bar members 130 and 132 are positioned together and the surfaces are positioned adjacent each other. Separation of the upper and lower bar members 130 and 132 thus provides access to the apertures 128 enabling the set of cords 120 to be inserted directly into the apertures 128 resulting in simple, fast and easy installation of the cords 120 into the apertures 128. Advantageously, the installation of the cords 120 may be performed when the remaining components of the hammock 110 are connected together or prior thereto. Thus, the split bar design facilitates assembly of the hammock thereby reducing its cost of manufacture.

As with embodiment 10, each of the upper and lower bar members 130 and 132 preferably have snap connectors 146 which preferably include male connectors 148 mounted on the upper bar member 130 at its lower surface 144 and at end portions 150 thereof, as shown in FIGS. 10 and 11. Each male connector 148 is preferably forked and includes prongs 152 with protuberances 153 having a horizontally flat surfaces 154 at lower portions 155 of the connector 148. The snap connectors 146 also preferably include female connectors 158 mounted on the lower bar member 132 at the upper surface 140 and at end portions 160 thereof. Each female connector 158 preferably includes a constriction 162 at the upper portion 164 thereof which has a horizontally flat surface 166 at its medial portion 168. The coengaging male and female connectors 148 and 158 enable the upper and lower bar members 130 and 132 to be securely joined together.

The body supporting member 118 preferably includes a sheet 180 composed of suitable fabric to support the body of the user thereon. The sheet 180 is preferably rectangular but may also be any other suitable shape. The set of suspension cords 120 are preferably connected to opposing longitudinal ends 116 of the sheet 180 at connection points 174 thereof which are evenly spaced apart in order to evenly distribute the suspension forces exerted on the sheet 180, as shown in FIGS. 7 and 10. The suspension cords 120 are also preferably knotted at locations 176 thereof between the net 170 and the spreader bars 110. The knots 178 are preferably larger than the diameter of the apertures 128 to prevent the spreader bars 110 from sliding down over the knots 178 and excessively close to or encroaching on the sheet 180. As with embodiment 10, this prevents the spreader bars 110 from undesirably contacting the user's head or feet and thereby interfering with the user's comfort.

Accordingly, there has been provided, in accordance with the invention, an improved spreader bar for a hammock which provides enhanced safety to the hammock user and facilitates assembly of the hammock. It is to be understood that all the terms used herein are descriptive rather than limiting. Although the invention has been described in conjunction with the specific embodiments set forth above, many alternative embodiments, modifications and variations will be apparent to those skilled the art in light of the disclosure set forth herein. Accordingly, it is intended to include such alternative embodiments, modifications and variations that fall within the spirit and scope of the invention as set forth in the claims hereinbelow.

What is claimed is:

1. A spreader bar for connection to a body supporting member, comprising:

an elongated spreader bar body, said body being curved in a direction horizontally transverse to direction of elongation of said spreader bar body and curved longitudinally outwardly relative to the body supporting member when connected thereto, said bar body having apertures extending through said bar body for receiving cords therein which extend therethrough for connection to the body supporting member.

2. The spreader bar of claim 1 further including a means for securely fastening together said upper and lower bar members.

3. The spreader bar of claim 2 wherein said means for securely fastening includes coengageable male and female connectors mounted at mating end portions of said upper and lower bar members.

4. The spreader bar of claim 1 wherein said spreader bar body further includes channels extending along entire length of the apertures, said channels located and oriented so that the apertures are open along their entire length at a side portion of walls defining the apertures thereby providing access thereto when said upper and lower bar members are separated from each other and closed at the side portion when said upper and lower bar members are joined together.

5. The spreader bar of claim 1 wherein said bar body is split into upper and lower bar members and plane of division of each of said spreader bar body into said upper and lower bar members intersects the apertures through their entire length so that said upper bar member includes at least a portion of walls defining the apertures and said lower bar member includes other portions of said walls thereby providing access to the apertures when said upper and lower bar members are separated from each other and closure of the walls when said upper and lower bar members are joined together.

6. The spreader bar of claim 1 wherein the apertures are longitudinally oriented and parallel to each other.

7. The spreader bar of claim 1 wherein the apertures of said spreader bar body are oriented radially outwardly from center of circle of arc of curvature of said spreader bar body.

8. The spreader bar of claim 1 wherein the apertures are evenly spaced apart.

9. The spreader bar of claim 1 wherein the apertures are tubular and straight.

10. The spreader bar of claim 1 wherein cross-sectional size of the apertures is larger than cross-sectional size of the cords to allow free movement of the cords relative to and within the apertures.

11. The spreader bar of claim 1 wherein width of said spreader bar body is approximately equal to shoulder width of an average size user.

12. The spreader bar of claim 1 wherein said bar body has a radius of curvature of approximately twenty-two inches thereby providing said bar body with an arc of curvature having its center at a means for attaching the cords to an external structure.

13. A spreader bar, comprising:

an elongated spreader bar body, said body being curved in a direction horizontally transverse to direction of elongation of said spreader bar body, said bar body having apertures extending through said bar body for receiving cords therein which extend therethrough, said bar body including an upper and lower bar member, said upper and lower bar members having snap connectors for secure interconnection thereof, said lower member having channels extending along entire length of the apertures providing access to the apertures when said upper and lower members are separated for allowing insertion of the cords therethrough and into the apertures when said cords are interconnecting component parts of a hammock, said upper bar member covering the channels when said upper and lower members are interconnected for blocking access to the apertures for retention of the cords in the apertures.

14. A spreader bar, comprising:

an elongated spreader bar body, said body being curved in a direction horizontally transverse to direction of elongation of said spreader bar body, said bar body having apertures extending through said bar body for receiving cords therein which extend therethrough, said apertures of said spreader bar body being tubular and radially oriented with reference to arc of curvature of said spreader bar body.

15. A spreader bar, comprising:

an elongated spreader bar body, said body being curved in a direction horizontally transverse to direction of elongation of said spreader bar body, said bar body having apertures extending through said bar body for receiving cords therein which extend therethrough, said apertures of said spreader bar body being radially oriented with reference to arc of curvature of said spreader bar body.

* * * * *